US011178984B2

(12) United States Patent
Derndinger

(10) Patent No.: US 11,178,984 B2
(45) Date of Patent: Nov. 23, 2021

(54) CHANGEABLE FRAME

(71) Applicant: Katrin Derndinger, Duesseldorf (DE)

(72) Inventor: Katrin Derndinger, Duesseldorf (DE)

( * ) Notice: Subject to any disclaimer, the term of this patent is extended or adjusted under 35 U.S.C. 154(b) by 0 days.

(21) Appl. No.: 16/611,697

(22) PCT Filed: May 24, 2018

(86) PCT No.: PCT/EP2018/063626
§ 371 (c)(1),
(2) Date: Nov. 7, 2019

(87) PCT Pub. No.: WO2018/215586
PCT Pub. Date: Nov. 29, 2018

(65) Prior Publication Data

US 2020/0163472 A1 May 28, 2020

(30) Foreign Application Priority Data

May 24, 2017 (DE) ..... 20 2017 103 151.9

(51) Int. Cl.
*A47G 1/06* (2006.01)
*A47F 7/14* (2006.01)
*G09F 1/12* (2006.01)

(52) U.S. Cl.
CPC ..... *A47F 7/146* (2013.01); *A47G 1/0605* (2013.01); *A47G 1/065* (2013.01); *A47G 1/0616* (2013.01);
(Continued)

(58) Field of Classification Search
CPC .. A47G 1/06; A47G 1/065; A47G 2001/0688; G09F 1/12; G09F 3/20; G09F 7/10; G09F 7/18; G09F 11/00
See application file for complete search history.

(56) References Cited

U.S. PATENT DOCUMENTS 1,017,563 A * 2/1912 Lain et al. ..... G09F 7/00 40/611.07
2,414,183 A * 1/1947 Wolf ..... B44D 3/185 40/725
(Continued)

FOREIGN PATENT DOCUMENTS

DE 547662 C 4/1932
DE 7732814 U1 4/1978
(Continued)

*Primary Examiner* — Cassandra Davis
(74) *Attorney, Agent, or Firm* — Laurence A. Greenberg; Werner H. Stemer; Ralph E. Locher

(57) ABSTRACT

A changeable frame allows exhibits presented therein to be exchanged in a simplified manner. The frame includes a frame element surrounding a frame opening in which the exhibit is visible from an observer side. A recess in the frame element leads from a lateral outer surface to an opposite inner surface of the frame element and opens into the frame opening for insertion of the exhibit into and removal of the exhibit from the frame opening. A drawer slidably mounted in the recess has a receptacle for positioning the exhibit. The drawer is slidable between an insertion position, in which the exhibit is visible in the frame opening, and a removal position, in which the receptacle of the drawer is outside of the frame element for the removal of the exhibit from the receptacle.

10 Claims, 6 Drawing Sheets

(52) U.S. Cl.
CPC ..... *A47G 1/06* (2013.01); *A47G 2001/0688* (2013.01); *G09F 1/12* (2013.01)

(56) References Cited

U.S. PATENT DOCUMENTS

| | | | | | |
|---|---|---|---|---|---|
| 4,149,331 | A | | 4/1979 | Prager | |
| 4,241,529 | A | * | 12/1980 | Baur | B42F 7/14 40/490 |
| 4,242,820 | A | * | 1/1981 | Ackeret | G03B 23/02 40/513 |
| 4,691,456 | A | * | 9/1987 | Ackeret | B42F 7/14 40/721 |
| 4,998,361 | A | * | 3/1991 | Gordon | A47G 1/0616 206/451 |
| 5,105,567 | A | * | 4/1992 | Real | A47G 1/065 40/765 |
| 5,421,111 | A | * | 6/1995 | Primm | A47G 1/06 40/721 |
| 7,984,578 | B2 | * | 7/2011 | Kabel | A47G 1/12 40/765 |
| 2008/0187688 | A1 | | 8/2008 | Gunther | |

FOREIGN PATENT DOCUMENTS

| | | | |
|---|---|---|---|
| KR | 1020150118288 | A | 10/2015 |
| NL | 1025968 | C1 | 10/2005 |

* cited by examiner

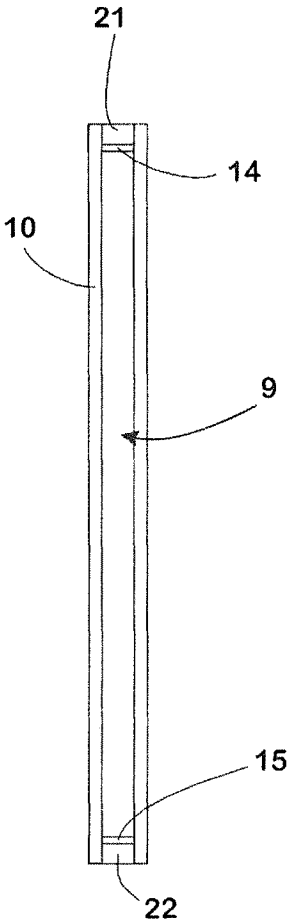
Fig. 9
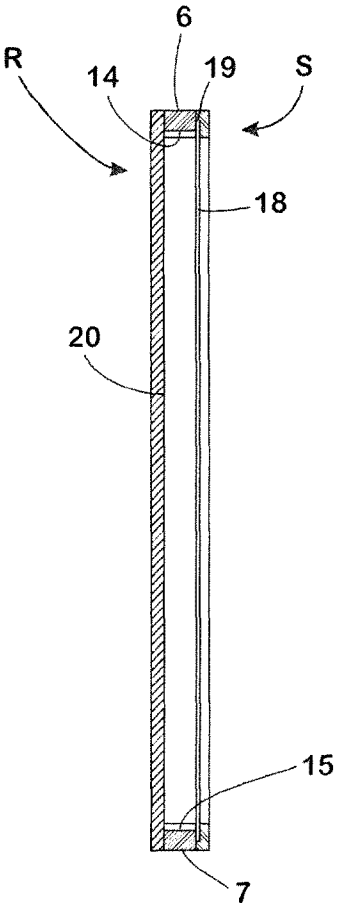
Fig. 8
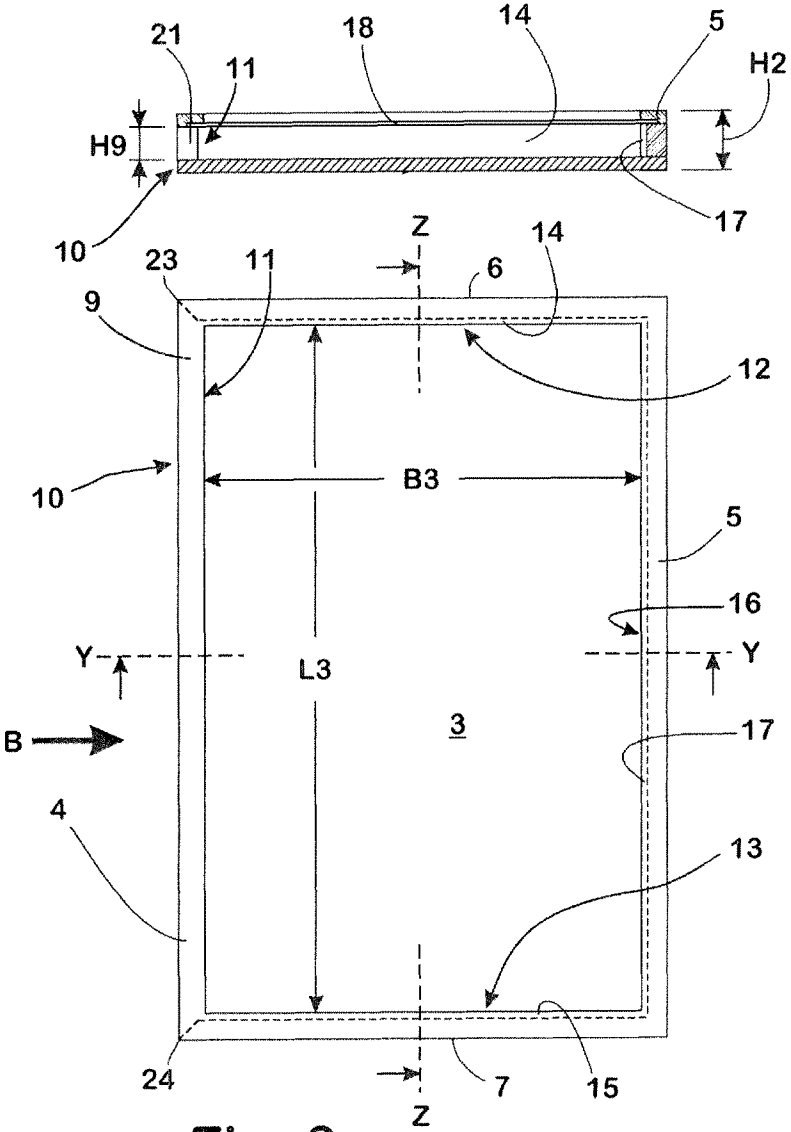
Fig. 7
Fig. 6

CHANGEABLE FRAME

BACKGROUND OF THE INVENTION

Field of the Invention

The invention relates to a changeable frame for the presentation of exhibits. Examples of such exhibits include art objects or design objects and the like which are presented in the art trade. The exhibits presented in a frame according to the invention can equally also be objects of upmarket requirements, such as glasses frames, cloths, perfume bottles and the like.

In particular, a changeable frame according to the invention serves for the presentation of individual sheets, in particular for the presentation of individual sheets of paper or the like on which artistic illustrations, such as drawings, etchings, prints or photos are reproduced.

The generic term "individual sheets", for the presentation of which a changeable frame according to the invention is particularly suitable, should be understood here as meaning all sheet-like objects extending in a flat manner and the thickness of which is substantially smaller than their width and length. Typical examples of such sheet-like objects are artistic prints, lithographs or images reproduced in some other manner by printing on a sheet-like carrier material, and other artistic illustrations. Furthermore, "individual sheets" within the context of the invention include sheets with drawings, paintings and the like, and also photos.

Individual sheets of this type are typically artistic works, such as lithographs, artistic prints or high-value photos, which are issued in small numbers and are shown in private or public exhibitions in a frame of the type under discussion here.

For the presentation of the respective individual sheet, changeable frames conventionally have a frame element which surrounds a frame opening. The object to be presented sits, during use, in the frame opening in such a manner that said object can be freely perceived by a viewer standing on the viewer's side of the changeable frame.

In order, for example, in the case of a changeable frame to simplify the exchange of an individual sheet to be shown in each case, DE 7732814 U1 has already proposed an image frame which is provided in particular for photos and which has an upper portion and a lower portion which lie parallel to each other. The portions are connected at their one end by a first side portion. The upper portion, the lower portion and the first side portion connecting them each have a notch on the inner side. The notches of the portions are shaped in such a manner that they adjoin one another. They thereby form a C-shaped receptacle for the photo to be shown in each case. A second side portion which is oriented parallel to the first side portion is fastened between the other ends of the upper and lower portion. Said second side portion is provided with a recess in the form of a longitudinal slot which reaches substantially over the entire length of the portion. Notches formed in the upper and lower portions open in the longitudinal slot. The photo to be presented in each case can thereby be pushed through the slot into the C-shaped notch receptacle of the frame. In order to secure the photo pushed in each case into the frame, the slot can be closed by a closure rail. For this purpose, a slideway, into which the closure rail is inserted, can be provided on that side portion of the frame which is provided with the slot.

In the case of an image frame configured in such a manner, the individual sheet can be exchanged in a comparatively simple manner. Unlike in conventional image frames, the conventionally present rear wall of the frame does not have to be removed here in order to change the respective image. On the contrary, the refitting or the exchange of the individual sheet to be presented in the changeable frame can take place by easy plugging into the frame or pulling out of the frame.

In many cases, individual sheets are compiled to form collections or series which have a certain thematic or temporal relationship. For example, it has long been a tradition to combine twelve graphics, photos or the like to form a calendar, in which each month is assigned a dedicated individual sheet. For this purpose, the individual sheets are conventionally fastened to a carrier sheet on which date details are then also printed. The carrier sheets here are generally connected to one another in such a manner that, at the start of the month, the calendar sheet of the respectively expired month, which calendar sheet has been visible up to now on the front side of the calendar, can simply be turned to the rear side of the calendar and the calendar sheet of the new month becomes freely visible on the front side of the calendar. This handling which is simple per se may, however, be problematic if the carrier sheets are large and do not have sufficient inherent rigidity. In this case, during the handling, the carrier sheets can form folds or creases, and therefore the individual sheet respectively fastened thereto is also creased. Furthermore, damage to the individual sheets carried by the carrier sheets can be caused by the adhesives or mechanical fastening means used for the fastening. It frequently occurs that, despite the use of special adhesives, the structure and color of the respective sheet is changed. Mechanically acting fastening aids can also cause pressure marks, tears or similar damage to the generally valuable individual sheets.

SUMMARY OF THE INVENTION

Against this background, the object has arisen of providing a changeable frame in which it is possible in a furthermore simplified manner to exchange the exhibits presented in each case in the frame.

The invention has achieved this object by means of a changeable frame having the features specified below.

Advantageous refinements of the invention are specified in the dependent claims and will be explained in detail below as the general inventive concept.

Accordingly, in accordance with the prior art explained at the beginning, a changeable frame according to the invention for the presentation of exhibits has a frame element which surrounds a frame opening in which, during use, the exhibit to be presented is arranged visibly as seen from a viewer's side, wherein the frame element has a recess which leads from the lateral outer surface of the frame element to the opposite inner surface of the frame element, opens in the frame opening and is provided for the insertion of the respective exhibit into the frame opening and for the removal of the exhibit from the frame opening. The "viewer's side" refers here to that side of the changeable frame at which the viewer looks during normal use of the changeable frame.

According to the invention, a drawer which has a receptacle for the positioning of the exhibit is now mounted displaceably in the recess, wherein the drawer is displaceable between an insertion position, in which the exhibit is visible in the frame opening, and a removal position, in which the receptacle of the drawer is situated outside the frame element for the removal of the exhibit present in said receptacle.

The invention consequently uses the concept of introducing the exhibit, which is to be presented in the changeable frame according to the invention, via a recess into the frame opening and of removing same therefrom such that no awkward opening of the frame is required for exchanging the object presented in each case. The invention additionally provides an aid, namely the drawer which, according to the invention, is mounted in the recess, can be inserted into the frame opening through the recess and can be pulled out again from the frame opening via the recess. For this purpose, said drawer is designed in such a manner that it can receive the respective exhibit. When the drawer is inserted completely into the frame, the exhibit is then presented in the frame in a manner visible for the viewer.

The particular advantage of the refinement according to the invention of a changeable frame consists here not only in that the respective exhibits can be introduced into the frame and exchanged in a simple manner, but also in that the object presented in each case as the exhibit in the changeable frame can easily be readjusted, supplemented or corrected in any other form in respect of its orientation, arrangement, completeness, etc. by the drawer being able to be pulled out of the frame element and the object which is then freely accessible being able to be correspondingly dealt with.

The changeable frame according to the invention is particularly suitable for the presentation of individual sheets, in particular individual sheets of paper or the like, on which an artistic illustration, such as a drawing, an etching, a print or a photo is reproduced.

The invention makes it possible here to design the receptacle of the drawer for the depositing of a stack of two or more exhibits lying on one another, in particular individual sheets, wherein, when the drawer is in the insertion position, that exhibit, in particular individual sheet, of the stack that lies uppermost with respect to the viewer's side is then in each case visible in the frame opening. In the changeable frame according to the invention, for example, a stack of in particular sheet-like objects presorted as desired can thereby be placed into the receptacle. In particular, the changeable frame according to the invention makes it possible in this case to present exhibits, in particular individual sheets, compiled to form a collection in a certain defined sequence.

If the exhibit, in particular individual sheet, lying uppermost in each case on the stack is intended to be changed for a new exhibit, in particular individual sheet, the drawer can be pulled out of the frame in an extremely simple manner to such an extent that the stack lying in the receptacle of the drawer is situated outside the frame element in a manner sufficient for removal. The stack can then be removed from the receptacle and, for example, the exhibit, in particular individual sheet, which up to now has been uppermost can be placed under the exhibit, in particular individual sheet, which up to now has been lowermost. In this manner, for example, the conventional sequence in a calendar of the presentation of an exhibit, in particular individual sheets, can readily be brought about in a changeable frame according to the invention without individual exhibits, in particular individual sheets, in particular having to be introduced for this purpose awkwardly into a slot, or a likewise awkward re-sorting bringing the risk of damage to the exhibits, in particular individual sheets, being required.

For example, a collection of twelve exhibits, in particular individual sheets, of which in each case one is assigned to one month of the current year, can thereby be readily compiled.

In order to carry out the function of a calendar here, a calendar can be provided for the changeable frame according to the invention. For this purpose, a separate holder can be provided in the form, for example, of a stand on which a stack of, for example, twelve cards is deposited, of which the card arranged uppermost in each case indicates the dates of the current month. If the month has expired, the card lying uppermost, like the sheet lying uppermost in the case of the stack of exhibits, in particular individual sheets, deposited in the changeable frame, can be arranged to the end of the stack such that the card assigned to the following month lies uppermost and therefore the dates indicated thereon are freely visible.

In order to facilitate the sorting, the holder can have a first supporting element, for example in the form of a flat plate. At the lower end of the holder in the direction of gravity, there can be a foot portion which is provided for the depositing of the card assigned to the respectively current month, the rear side of which card, when the card stands on the foot, is supported against the supporting surface. The foot portion then forms a first support via which the holder is supported against the respective underlying surface on which the holder stands.

A receiving slot into which the calendar cards which are not required in each case can be inserted can optionally be formed behind the preferably plate-like supporting element. On its side facing away from the first supporting element, the receiving slot can be bounded by a preferably likewise plate-like second supporting element which advantageously extends parallel to the first supporting element. The first supporting element is advantageously of such a height here that it completely covers the card-like objects inserted in the receiving slot. The view is thereby concentrated on the card arranged on the front side of the first supporting element. The height of the second supporting element can also be dimensioned in such a manner that the objects arranged in the receiving slot are supported over a height sufficient to avoid them folding over.

The first and second supporting element are preferably inclined at an acute angle in relation to the underlying surface and are oriented parallel to each other such that the card positioned on the front side of the first supporting element can be readily perceived by the viewer and, because of the effect of gravity, lies securely against the first supporting element without additional aids being required for this purpose.

Finally, a, for example, likewise plate-like supporting strut which supports the holder against the respective underlying surface can be supported against the second supporting element.

In order to prevent the card stack from dropping out of the receiving slot, the receiving slot of the holder can be closed on its one lateral side. It is self-evident here that such a holder is suitable not only for holding calendar cards, but also for all other card-like objects, such as postcards, memos, etc.

The holder like the changeable frame can be produced from wood, and therefore an attractive uniform image is produced from the combination of changeable frame and holder.

The displacement of the drawer provided according to the invention between the insertion position, in which the drawer is inserted as far as its end position in the frame element, and the removal position, in which the receptacle of the drawer is situated sufficiently far outside the frame element for the removal of the respective exhibit, takes place, in the case of the changeable frame according to the invention, in a linear sliding movement typical of drawers.

The invention therefore provides a changeable frame which, in easily handleable manner, permits the presentation of changing exhibits and, in particular in a simple manner, permits the presentation of individual sheets, which are compiled to form a collection, in a certain sequence.

A changeable frame according to the invention can have basically any desired shape as long as it has a frame element provided with a recess which leads continuously from the outer side to the frame opening and in which the drawer provided according to the invention is mounted displaceably.

The mounting of the drawer in the frame element can be realized in a particularly simple manner if the frame element has a first transverse side portion on a first side and a second transverse side portion on a side which is opposite the first side, said transverse side portions each being oriented transversely with respect to the recess in which the drawer is mounted. In this case, a guide for the drawer can be formed in a simple manner on one or on both of the transverse side portions.

This use of the transverse side portions for guiding the drawer is simple in particular if the frame element, as seen from the viewer's side, a square basic shape with two longitudinal side portions which extend parallel to each other and are connected to each other at their one end by the one transverse side portion and at their other end by the second transverse side portion of the frame.

The transverse side portions will customarily extend parallel to each other in practice here such that the frame element is rectangular or square-shaped. With this orientation of the side portions, parallel guidance of the drawer in or on the two transverse side portions, which are oriented parallel to each other and at right angles to the longitudinal side portions, can be realized particularly simply.

A sliding guide for the drawer provided according to the invention can be attached to the inner side of the frame element or can be formed in the relevant inner side of the frame element. It is conceivable to use as sliding guides, for example, commercially available guide rails or the like which are fastened to the frame element and on which the drawer is guided in a sliding manner during the insertion and pulling out. However, a sliding guide for the drawer can be realized in a particularly simple and cost-effective and also visually particularly attractive manner if a guide groove is provided as the sliding guide in the transverse side portion, provided in each case therewith, of the frame element. The drawer can slide in said groove without additional components being required.

A drawer guide which is optimally concealed and does not obstruct the free view of the object to be presented is produced in the frame element by the sliding guide extending over the entire length of the inner side of the transverse side portion provided in each case therewith. Simple, complete removal of the drawer from the frame element can be made possible here by the fact that the sliding guide opens with its end assigned to the recess into the recess of the frame element. If, by contrast, protection against the drawer being unintentionally pulled out too far is intended to be provided, this can be realized in a simple manner by a stop being provided in the recess, in which the drawer is mounted, against which stop the drawer strikes by means of a shoulder fastened thereto, when the drawer has reached its removal position pulled out of the frame element to the maximum.

The receptacle of the drawer can be provided with suitable holding elements or other molded parts for holding the exhibit, to be deposited in each case in said drawer, by means of which the exhibit is held in place in the drawer in a manner corresponding to its designated position. For example, for this purpose, the receptacle of the drawer can be bounded on at least one side by an edge strip. The respectively provided edge strips can be used for guiding the drawer in or on the sliding guides provided for this purpose on the frame element. This configuration proves particularly advantageous if the sliding guides for the drawer are provided as grooves in the transverse side portions of the frame element, and the respectively assigned edge strip is designed and positioned in such a manner that the inner side, which faces the receptacle of the drawer, of the edge strip assigned to the respective sliding guide is oriented flush with the inner side of the respectively assigned transverse side portion. In such an arrangement of the edge strip, the sliding guides provided for the drawer on the changeable frame according to the invention cannot be seen by the viewer when the drawer is in its insertion position. The corresponding placing of the edge strip can be brought about in a simple manner by the fact that the thickness of the edge strips of the drawer that are assigned to the transverse side portions of the frame element is equal to the depth of the guide groove provided as a sliding guide in the respective transverse side portion.

The holding of the drawer in its insertion position can be particularly protected by the fact that a receptacle in which the drawer sits in the insertion position with its edge region assigned to the receptacle is molded into the inner side of that portion of the frame element which is opposite the mouth of the recess. If an edge strip is also provided on this side of the recess of the drawer, an optimized optical appearance is also produced here as a result of the fact that the edge strip is positioned on the drawer in such a manner that the inner side, facing the receptacle of the drawer, of the edge strip assigned to the respective sliding guide is oriented flush with the inner side of the respectively assigned longitudinal side portion of the frame element in the insertion position of the drawer. The desired flush orientation can also be ensured here in a simple manner by the fact that the depth of the receptacle which is molded into that portion of the frame element which is opposite the recess is equal to the thickness of the edge strip which is assigned to said receptacle.

When the drawer is in the insertion position, the recess of the frame element, in which the drawer is mounted, can be closed by an edge strip of the drawer. In order here to facilitate an orientation of the relevant edge strip in the recess that is also perfect in respect of the visual appearance of the changeable frame, run-on slopes can be provided on the lateral boundaries of the recess such that the recess from the outer surface of the frame element at least over part of the depth of the recess has a shape narrowing in a funnel-shaped manner in the direction of the frame opening. The edge strip assigned to the recess, at its ends which are assigned to the lateral ends of the recess, in each case has an edge portion on which an oblique surface which is oriented in a manner corresponding to the respectively assigned run-on slope of the recess is provided. When the drawer is in the insertion position, said oblique surface lies tightly against the associated run-on slope. The drawer itself is therefore centered via the run-on slopes and the assigned oblique surfaces of the relevant edge strip of the drawer when said drawer approaches its insertion position as it is being inserted into the frame opening.

The object to be presented is positioned in the frame opening surrounded by the frame element. It is self-evident here that the frame opening has to be open to the viewer in such a manner that the viewer can freely perceive the respectively presented object in the desired manner. This type of opening therefore does not necessarily require free access to the exhibit presented in the frame opening. On the contrary, it suffices if the frame opening is open visually, i.e. is transparent. Accordingly, it is self-evident that a transparent pane filling the frame opening can also be held on the frame element, said pane, during use, physically shielding the object visible in each case to the viewer in the frame opening from the viewer, but readily permitting the view of the respective exhibit.

In order to facilitate the holding of the stack in the drawer, the drawer can have a base on which the exhibit to be presented, in particular the stack of individual sheets, lies. The base here does not have to have a closed surface but rather can also be provided with perforations and the like, for example, in order to save weight or to ensure ventilation.

In order to protect the objects presented in the changeable frame from environmental influences and to optimize the stability of the changeable frame, it can be expedient to close the frame element at least in sections on its rear side facing away from the viewer's side. This can take place by means of a plate-like rear wall carried by the frame element.

The changeable frame according to the invention can be realized in a particularly simple and at the same time visually attractive manner by the fact that the frame element is manufactured at least from wood.

The drawer provided according to the invention can also be manufactured from wood.

The shape of the receptacle of the drawer can easily be adapted to the shape of the exhibit to be deposited therein. Since, for example, individual sheets which are particularly suitable as exhibits generally have a rectangular shape, it is advantageous for most situations if the receptacle of the drawer is also rectangular, as seen from the viewer's side.

A particularly readily displaceable mounting of the drawer in the recess of the frame element is produced when the recess is designed in the manner of a slot, in particular in the manner of a longitudinal slot.

The visual appearance of the changeable frame according to the invention can be adapted to the respective taste by at least one decoration element being fastened to the frame element. Said decoration element can be arranged, for example, as a further frame composed of a different material or a different color, on the viewer's side of the frame element. It is self-evident that the changeable frame according to the invention can be set up on a firm base, for example a floor or a table top, and can be lent here against a wall. The changeable frame according to the invention can also comprise a device for hanging the frame on a wall.

In order to ensure optimum presentation of the object shown in the changeable frame, even under unfavorable light conditions, said changeable frame according to the invention can be provided with a light source which lights the object. Said light source is optimally integrated in the drawer such that it can easily be maintained or exchanged by being pulled with the drawer out of the frame. For this purpose, the light source can be arranged, for example, on or in one of the edge strips of the drawer. For this purpose, a recess in which the light source sits can be molded in the relevant edge strip. The light source is optimally oriented here in such a manner that its end surface assigned to the receptacle surrounded by the drawer is arranged flush with the side surface of the respective edge strip, said side surface being assigned to the receptacle. For this purpose, particularly suitable light sources are individual light-emitting diodes ("LEDs") or light-emitting diodes combined to form strips, or the like, which output sufficient amounts of light while requiring minimum space and only slightly heat up in the process.

Alternatively or additionally to an arrangement of the light source to the side of the object to be presented, a light source can also be arranged within the frame in such a manner that the object is lit from its front side or from its rear side.

Lighting directed frontally onto the front side can be realized, for example, by the fact that the lighting device is arranged in the region of that edge of the changeable frame which surrounds the frame opening and is directed toward the front side of the object. Furthermore, a transparent light-conducting film or pane is conceivable as a light source for this purpose, said film or pane being arranged in front of the object, as seen by the viewer, and in which the light introduced, for example, laterally therein is reflected in such a manner that it frontally illuminates the object from the viewers view.

In the event that the object itself is transparent or particular optical effects are intended to be resolved by lighting taking place from the rear side thereof, a light directed at the object from behind can be integrated in a base of the drawer or of the changeable frame. Light-conducting films, plates or the like can also be used here for this type of lighting in order to obtain a uniform planar illumination. Similarly, for this purpose, use can be made, for example, of LEDs or comparable light-emitting structural elements which are arranged in a suitable distribution on the respective floor surface. In order to obtain uniform illumination here, a disk-like diffuser can be arranged if required between the object to be lit and the spot- or line-shaped light sources, the diffuser scattering the light which is generally emitted in a spot-shaped manner by the LEDs in such a manner that the viewer perceives a uniformly illuminated surface.

An energy supply device required for operating the light source, for example a battery, a rechargeable accumulator or a network part which can be connected to the power supply of a building can also be integrated in the frame. In order also here to permit easy maintenance and repair, it is advantageous to likewise integrate the energy supply device in the drawer. One of the edge strips which surround the receptacle of the drawer of the frame according to the invention is likewise appropriate as the location for the arrangement of the energy source.

BRIEF DESCRIPTION OF THE SEVERAL VIEWS OF THE DRAWING

The invention will be explained in more detail below with reference to a drawing illustrating an exemplary embodiment. In the figures of the drawing, in each case schematically:

FIG. 6 shows a frame element of the changeable frame in a view corresponding to FIG. 1;

FIG. 7 shows the frame element in a section along the intersecting line Y-Y shown in FIG. 6;

FIG. 8 shows the frame element in a section along the intersecting line Z-Z shown in FIG. 6;

FIG. 9 shows the frame element in a lateral view from the direction B shown in FIG. 6;

DESCRIPTION OF THE INVENTION

Figure 1:
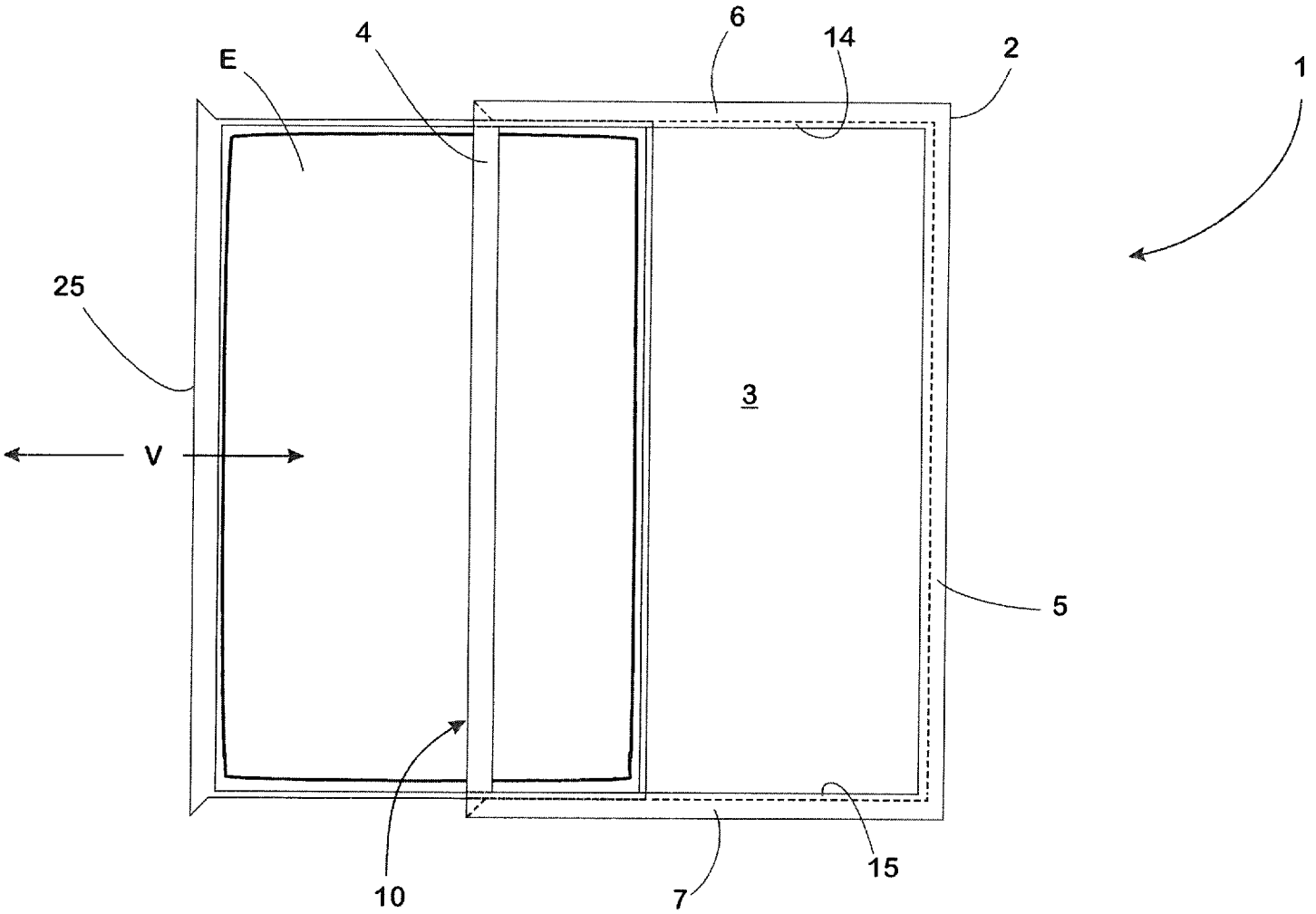
FIG. 1 shows a changeable frame with a pulled-out drawer in a top view as seen from the viewer's side.
Figure 3:
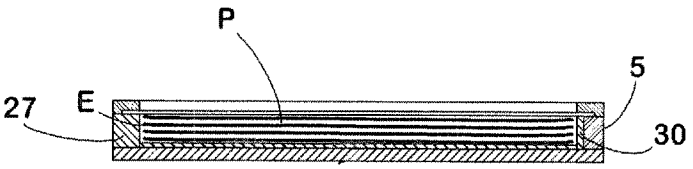
FIG. 3 shows the changeable frame in a section along the intersecting line X-X shown in FIG. 2.
Figure 4:
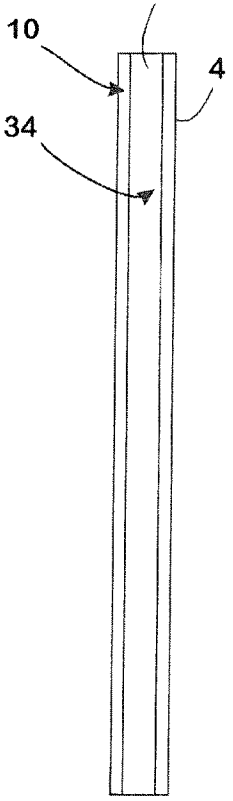
FIG. 4 shows the changeable frame in a lateral view from the direction A shown in FIG. 3.

The changeable frame 1 comprises a frame element 2 which has a rectangular basic shape and surrounds a likewise rectangular frame opening 3. The frame element 2 which is manufactured from wooden bars which are rectangular in cross section has two longitudinal side portions 4, 5 oriented parallel to each other and two transverse side portions 6, 7 oriented at a right angle to the longitudinal side portions 4, 5. The one transverse side portion 6 connects those ends of the longitudinal side portions 4, 5 which are assigned thereto, whereas the other transverse side portion 7 connects the opposite ends of the longitudinal side portions 4, 5 to each other.

A recess 9 shaped in the manner of a slot is formed in the one longitudinal side portion 4 and extends from the outer surface 10 of the longitudinal side portion 4 as far as the inner surface 11 assigned to the frame opening 3. The recess 9 is arranged centrally with respect to the height H2 of the frame element 2. The height H9 of the recess 9 is approximately one third of the height H2 of the frame element 2.

A groove 14, 15 which is rectangular in cross section is in each case formed in the inner sides 12, 13 of the transverse side portions 6, 7, said inner sides being assigned to the frame opening 3. The grooves 14, 15 each extend over the width B3 of the frame opening 3 and lead into the recess 9.

A likewise groove-shaped receptacle 17 which is rectangular in cross section is formed in the inner side 16 of the longitudinal side portion 5 opposite the mouth of the recess 9, the receptacle extending over the length L3 of the frame opening 3 and merging at its ends into the groove 14, 15 of the respectively adjacent transverse side portions 6, 7.

On the viewer's side S facing the viewer during use, a transparent glass pane 18 is inserted into the frame opening 3, said glass pane being held in a groove 19 which encircles the frame opening 3 above the grooves 14, 15 and the receptacle 17 and is provided in the longitudinal side portions 4, 5 and the transverse side portion 6, 7.

On the rear side R facing away from the viewer's side S, the frame element 2 carries a closed rear wall 20 which is formed by a wooden plate.

Figure 2:
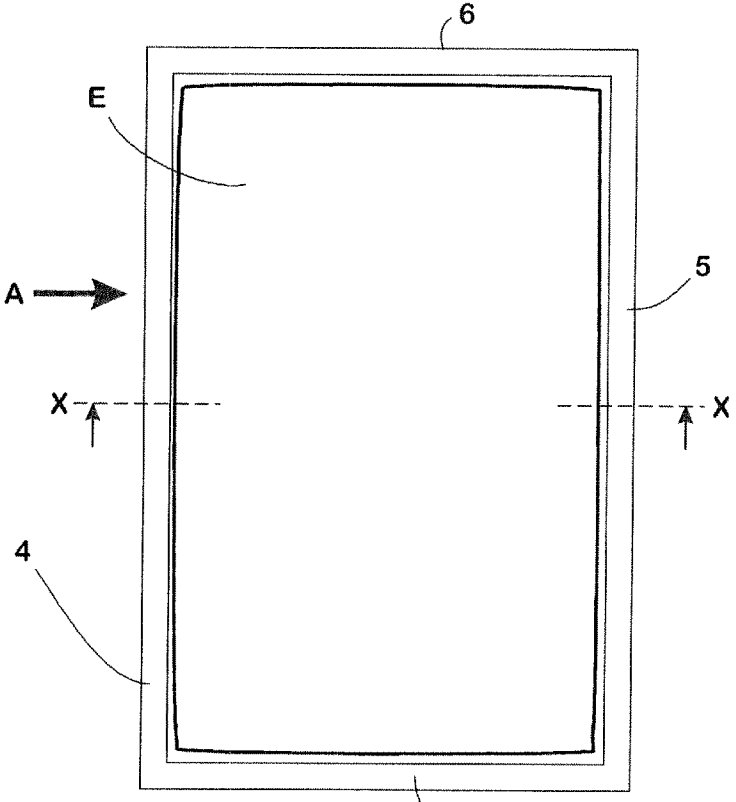
FIG. 2 shows the changeable frame with the drawer in the insertion position, in a view corresponding to FIG. 1.
Figure 5:
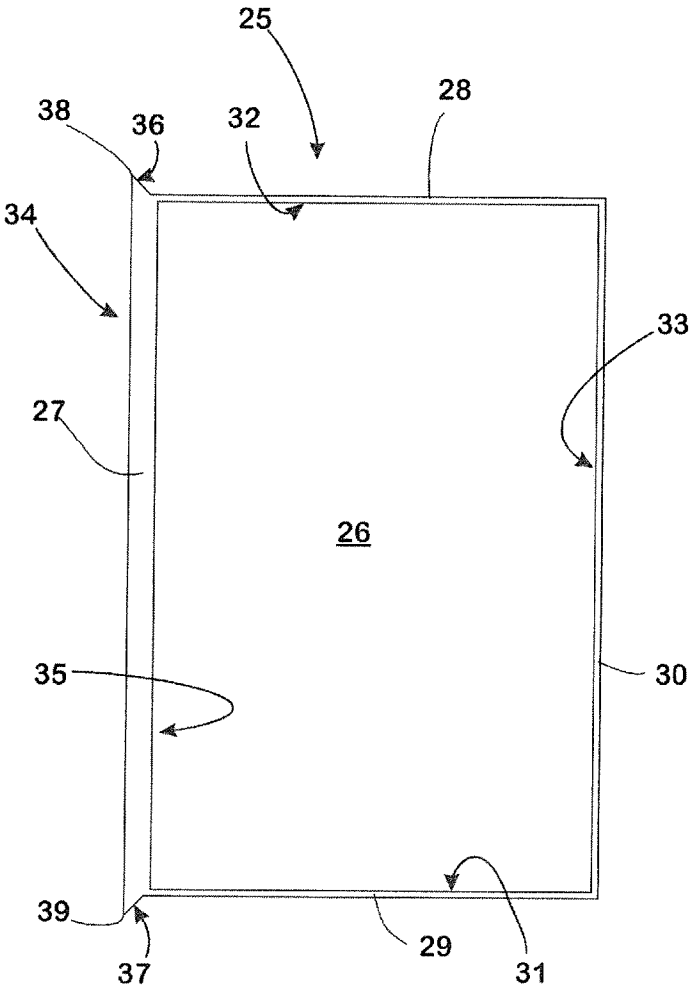
FIG. 5 shows the drawer of the changeable frame in a view corresponding to FIG. 1.

The side surfaces 21, 22 by means of which the recess 9 is bounded on its narrow sides, from the corners 23, 24 in which the transverse side portions 6, 7 and the longitudinal side portion 4 in each case meet, are oriented at an angle of 45° with respect to the groove 14, 15 assigned in each case to them. The recess 9 thereby narrows from the corners 23, 24 in the direction of the frame opening 3 in the manner of a funnel, and the side surfaces 21, 22 form run-on slopes via which a drawer 25 which is mounted displaceably in the recess 9 is centered in its insertion position (FIG. 2) in the recess 9.

The drawer 25 is displaceable in the grooves 14, 15 in a rectilinear movement V between an insertion position in which it is completely inserted into the frame element 2 (FIG. 2) and a removal position in which a receptacle 26 of the drawer 25 is located laterally next to the longitudinal side portion 4 of the frame element 2 outside the frame opening 3.

In this manner, when the drawer 25 is in the removal position, an individual sheet stack P formed from, for example, twelve individual sheets E can be placed into the receptacle 26. The depth of the receptacle 26 is dimensioned here in such a manner that it can still receive the stack P even if the individual sheets E are separated from one another by separating papers or the like placed therebetween.

As seen from the viewer's side S, the receptacle 26 has a rectangular basic shape and is adapted in its length and width to the dimensions of the individual sheets E in such a manner that the stack P can lie in the receptacle 26 with a play sufficient for avoiding damage to the individual sheets E. The receptacle 26 is bounded here on its longitudinal and transverse sides by edge strips 27, 28, 29, 30 and is closed on its rear side by a base. The edge strips 28, 29 are each assigned to one of the grooves 14, 15, the edge strip 30 to the receptacle 17 and the edge strip 27 to the recess 9.

The distance of the edge strips 28, 29 from each other and the thickness and height thereof are each adapted to the distance, the depth and the height of the grooves 14, 15 in such a manner that the edge strips 28, 29 can be displaced longitudinally with slight play in the grooves 14, 15, but at the same time their longitudinal sides 31, 32 assigned to the receptacle 26 of the drawer 25 are oriented flush with the inner sides 12, 13 of the respectively assigned transverse side portions 6, 7. Similarly, the distance between the edge strips 27 and 30 and the thickness and height of the edge strip 30 are adapted to the position, depth and height of the receptacle 17 in the longitudinal side portion 5 of the frame element 2 in such a manner that, when the insertion position is reached, the edge strip 30 can be inserted with slight play into the receptacle 17 and, when the drawer is completely inserted, is oriented with its inner side 33, which is assigned to the receptacle 26 of the drawer, flush with the inner side 16 of the longitudinal side portion 5.

The edge strip 27 assigned to the recess 9 is configured in respect of its thickness and height in such a manner that the edge strip 27 can be inserted with slight play into the recess 9 and at the same time, in the insertion position, the outer surface 34 of the edge strip 27 is arranged flush with the outer surface 10 of the longitudinal side portion 4 and the inner side 35 of the edge strip 27 is arranged flush with the inner surface 11 of the longitudinal side portion 4. The edge strip 27 at its ends assigned to the edge strips 28, 29 in each case has a laterally protruding end portion on which an oblique surface 36, 37 oriented at an angle of 45° is in each case provided starting from the respective edge strip 28, 29. With the oblique surfaces 36, 37, the drawer 25 in its insertion position lies tightly against the side surfaces 21, 22 of the frame element 2, said side surfaces serving as run-on slopes and laterally bounding the recess 9. The oblique surfaces 36, 37 are oriented and arranged here in such a manner that the free corner edges 38, 39 of the edge strip 27, in which corner edges the oblique surfaces 36, 37 peter out, coincide in the insertion position with the corners 23, 24 in which the longitudinal side portion 4 and the transverse side portions 6, 7 meet each other. When the drawer 25 is in the insertion position, the edge strip 27 is thereby integrated in the frame element 2 in such a manner that a flat outer surface is also produced on the longitudinal side portion 4.

Figure 10:
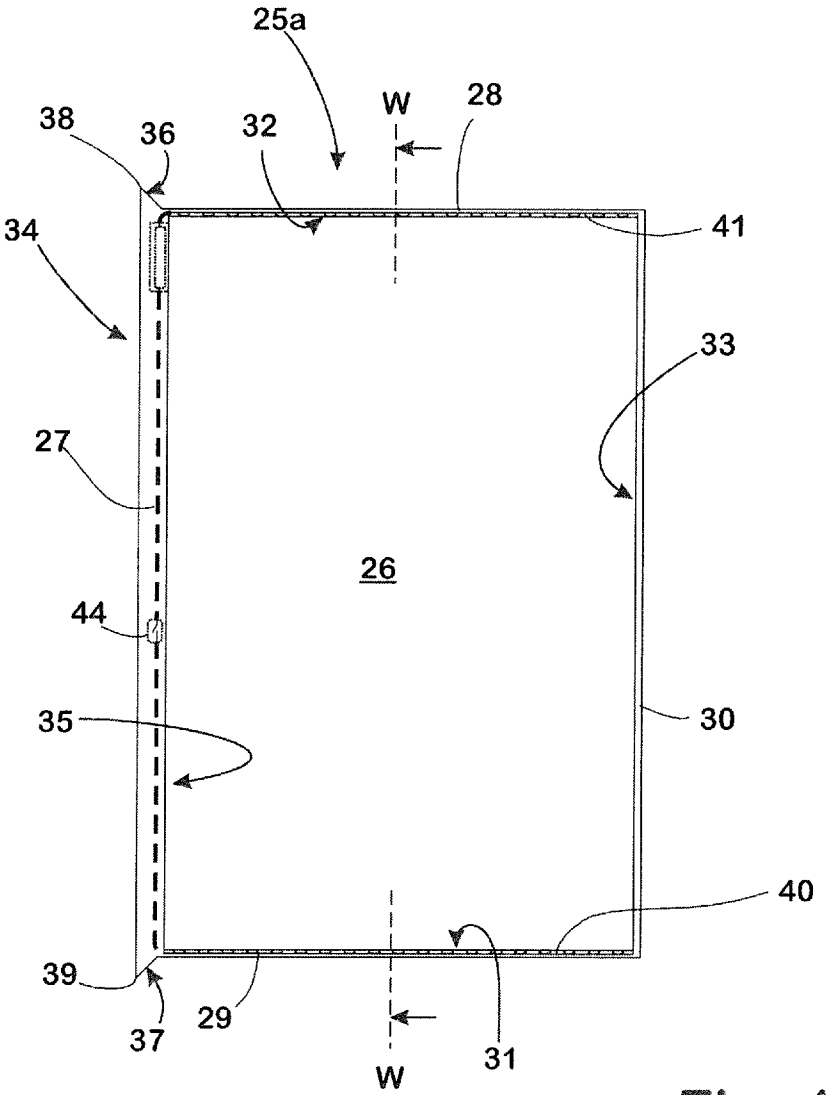
FIG. 10 shows an alternative embodiment of a drawer of the changeable frame.
Figure 11:
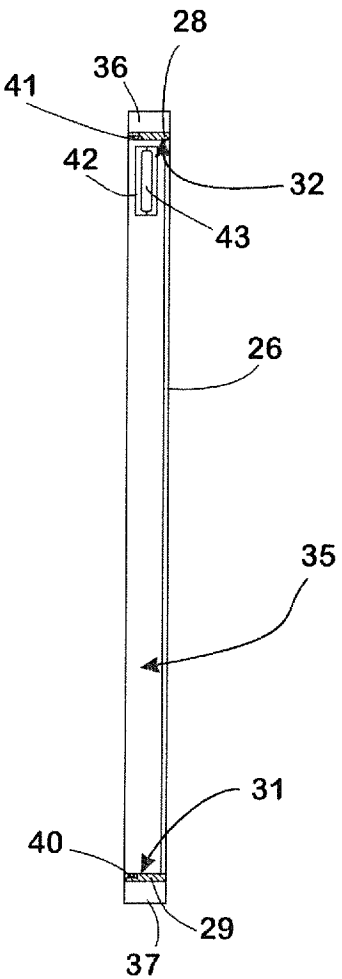
FIG. 11 shows the drawer according to FIG. 10 in a section along the intersecting line W-W shown in FIG. 10.
Figure 14:
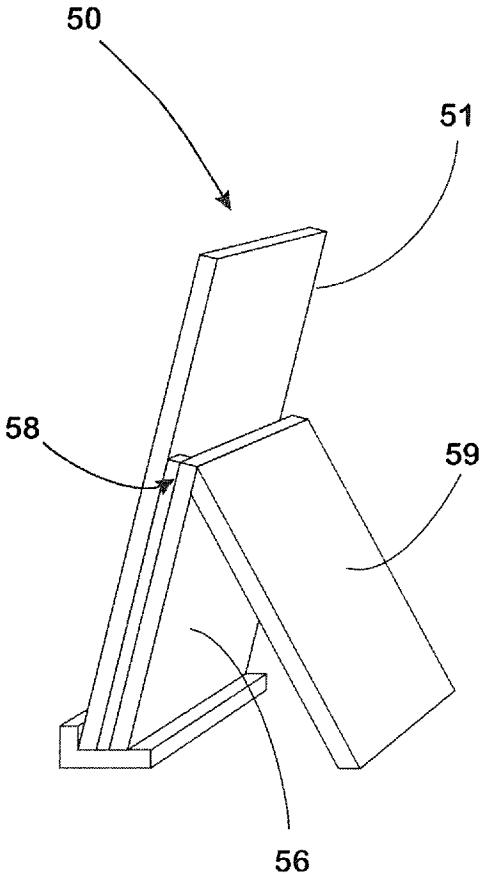
FIG. 14 shows the holder according to FIG. 12 in a perspective view from the rear.
Figure 13:
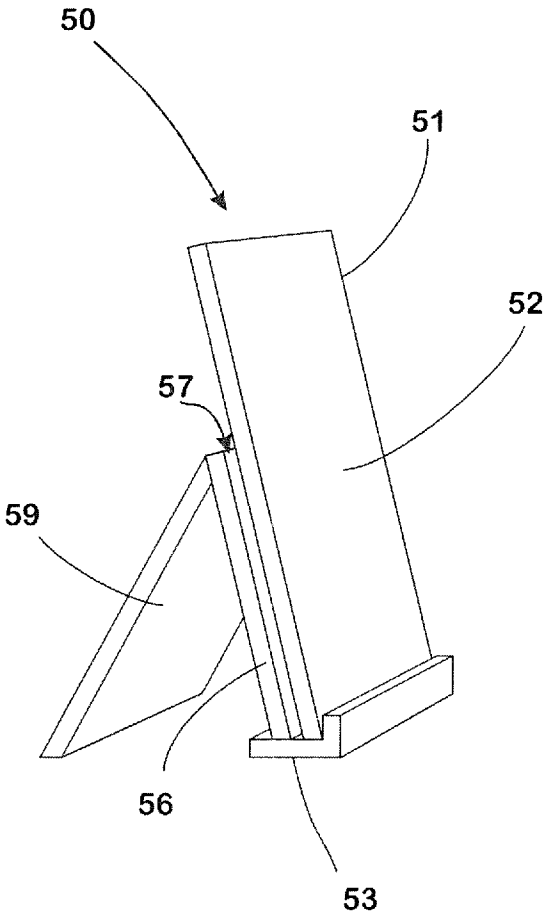
FIG. 13 shows the holder according to FIG. 12 in a perspective view from the front.
Figure 12:
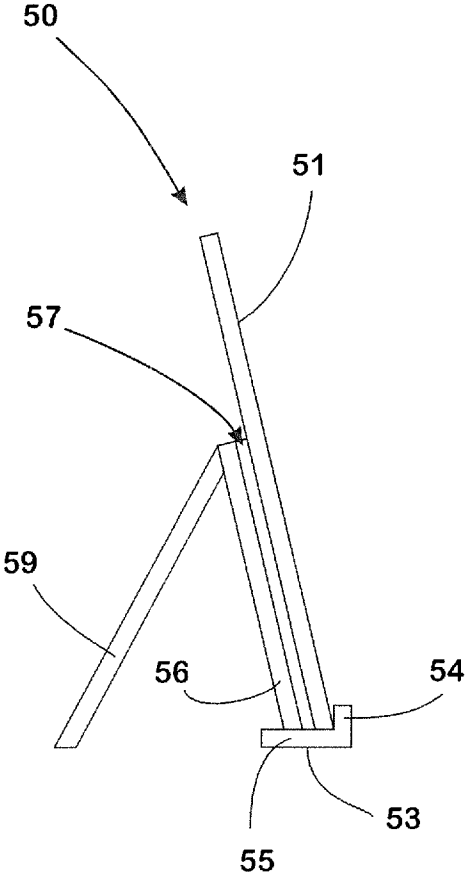
FIG. 12 shows a holder for a calendar in a lateral view.
Figure 16:
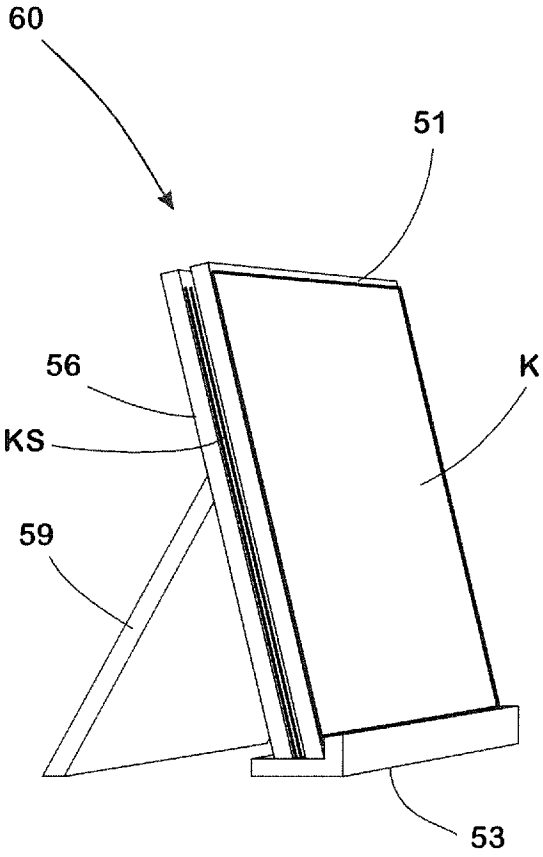
FIG. 16 shows the holder according to FIG. 15 in a perspective view from the front.
Figure 15:
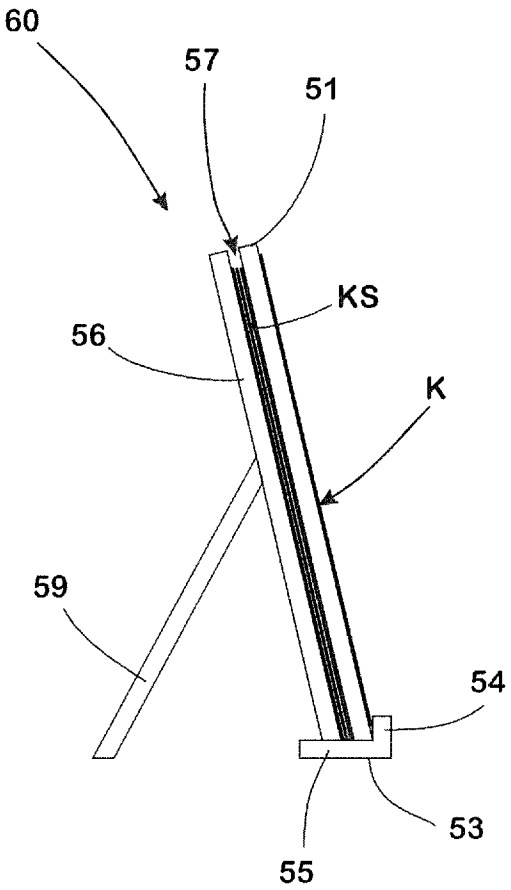
FIG. 15 shows another embodiment of the holder in a lateral view.

The drawer 25*a* shown in FIGS. 10 and 11 basically corresponds in its design identically to the previously explained design of the drawer 25. Therefore, in FIGS. 10 and 11, the corresponding components and details of the drawers 25, 25*a* are denoted by the same reference signs.

Beyond the details explained with regard to the drawer 25, the drawer 25*a* has two lighting devices 40, 41 which are arranged in the form of commercially available LED light strips on the inner sides of the shorter edge strips 28, 29, the inner sides each being assigned to the receptacle 26, and extend here over the length of the relevant edge strips 28, 29. For this purpose, starting from the free upper side of the edge strips 28, 29, a respective step extending over the length of the edge strips 28, 29 is molded into the edge strips 28, 29. The depth and height of said step is dimensioned in such a manner that the strip-shaped lighting devices 40, 41 are firstly oriented, with their end side which is assigned to the receptacle 26 and via which light is emitted, flush with the inner side 31, 32 and secondly are oriented with their upper side flush with the upper side of the respective edge strip 28, 29.

In order to supply the lighting devices 40, 41 with electrical energy, a compartment 42 in which, for example, a battery is placed as energy supply 43 is molded into the inner side 35 of the front-side edge strip 27, the inner side being assigned to the receptacle 26. The energy supply 43 is connected to the lighting devices 40, 41 via cable connections likewise incorporated into the edge strip 27. The lighting device 40, 41 can be switched on by means of a switch 44. The switch 44 can be designed here, for example, as a contact which closes the connection between the energy supply 43 and the lighting devices 40, 41 when the drawer 25*a* is inserted completely into the frame element 2, and interrupts said connection as soon as the drawer 25*a* is pulled out of the frame element 2. Alternatively or additionally, such a switch 44 can also be arranged on the outer side surface 34 of the edge strip 27 of the drawer 25*a* in order to be able to operate said switch from the outside, or the switch 44 can be designed, for example, as a magnetic switch or the like and embedded invisibly in one of the edge strips 27-30 in such a manner that it can be actuated by means of a suitable trigger, i.e., for example, by means of a magnet in the case of a magnetic switch. By arranging the lighting devices 40, 41 and the energy supply 43 and also the optionally provided switch in or on the drawer 25*a*, all of the elements which are required for lighting the object presented in the receptacle 26 of the drawer 25*a* can be maintained and if required repaired in a simple manner.

If the stack P arranged in the changeable frame 1 is intended to be used as a calendar, for example twelve individual sheets E are compiled to form the stack P and are deposited in the receptacle 26 of the drawer 25. In each case at the beginning of a new month, the drawer 25 is then moved into the removal position and the individual sheet E of the stack lying uppermost up to then is moved into the stack P to the rear such that the individual sheet E assigned to the current month lies freely visibly uppermost in the stack P.

In order, in addition to the individual sheet E respectively presented in the frame opening 3 of the changeable frame 1, to present the date, a card holder 50, 60 can be added to the changeable frame 1 which, for example, is hanging on a wall, leaning against a wall or standing on a table or floor.

For this purpose, the card holder 50, 60 which is assembled, for example, from wooden plate elements, has a first plate-like supporting element 51 which is oriented at an inclination toward the direction of gravity and has a flat supporting surface 52 on its free front side for an upright card K in each case, for example, in DIN A6 format. The first supporting element 51 stands here on a cross-sectionally L-shaped foot portion 53, the short limb 54 of which is oriented vertically upward and thus forms a stop against which the card K leaning against the supporting surface 52 is supported during use by its respectively bottom edge. The first supporting element 51 stands here on the long limb 55 of the foot portion 53, said limb being oriented horizontally during use, and is also supported by its lower front edge against the short limb 54 of the foot portion 53.

At a distance from the rear side of the first supporting element 51 and oriented parallel to the latter, a second supporting element 56 is supported on the long limb 55 of the foot portion 53. The width of the slot 57 formed between the supporting elements 51, 56 is dimensioned here in such a manner that, for example, a stack KS of eleven cards K in DIN A6 format has space between the supporting elements 51, 56. The slot 57 is closed on its one narrow side 58 in order to avoid the card stack KS dropping out.

On its side facing away from the first supporting element 51, the second supporting element 56 is supported by a likewise plate-like supporting strut 59 against the underlying surface on which the holder 50 is standing. The supporting strut 59 is supported here with respect to the second supporting element 56 in such a manner that an acute angle is enclosed between the supporting strut 59 and the second supporting element 56.

The height of the supporting elements 51, 56 is in each case dimensioned in such a manner that cards K supported thereon during use are supported over a length sufficient to avoid folding over.

In respect of an optimum appearance, the second supporting element 56 here is in each case so much shorter than the first supporting element 51 that an observer looking frontally toward the supporting surface 52 of the first supporting element 51 does not perceive the supporting element 56 located therebehind.

During use, the card K assigned to the respective month and on which the dates belonging to the relevant month are printed can lean in each case against the supporting surface 52 of the first supporting element 51. The cards K provided for the remaining eleven months of a year are put in the meantime in the slot 57. When the month changes, the card K assigned to the expired month is then put into the slot 57 to the cards K present there and the card K assigned to the beginning month is removed from the slot 57 and lent against the supporting surface 52.

REFERENCE SIGNS

1 Changeable frame
2 Frame element
3 Frame opening
4, 5 Longitudinal side portions
6, 7 Transverse side portions
9 Slot-shaped recess
10 Outer surface of the longitudinal side portion 4
11 Inner surface of the longitudinal side portion 4
12, 13 Inner sides of the transverse side portions 6, 7
14, 15 Groove (sliding guides)
16 Inner side of the longitudinal side portion 5
17 Receptacle

18 Glass pane
19 Groove
20 Rear wall
21, 22 Side surfaces (run-on slopes)
23, 24 Corners of the frame element 2
25, 25*a* Drawer
26 Receptacle of the drawer 25
27-30 Edge strips
31, 32 Inner sides of the edge strips 28, 29
33 Inner side of the edge strip 30
34 Outer surface of the edge strip 27
35 Inner side of the edge strip 27
36, 37 Oblique surfaces
38, 39 Corner edges of the edge strip 27
40, 41 Lighting devices
42 Compartment
43 Energy supply device
44 Switch
50, 60 Card holders
51 First plate-like supporting element
52 Flat supporting surface of the supporting element 51
53 Foot portion
54 Short limb of the foot portion 53
55 Long limb of the foot portion 53
56 Second supporting element
57 Slot
58 Narrow side of the slot 57
59 Plate-like supporting strut
B3 Width of the frame opening 3
E Individual sheets
H2 Height of the frame element 2
H9 Height of the recess 9
K Cards
KS Stack of cards
L3 Length L3 of frame opening 3
P Stack formed from the individual sheets E
R Rear side of the frame element 2
S Viewer's side
V Sliding movement of the drawer 2

The invention claimed is:

1. A changeable frame for the presentation of exhibits, the changeable frame comprising:

a frame element having a height, a viewer's side, a rear side facing away from said viewer's side, and mutually opposite lateral outer and inner surfaces, said frame element surrounding a frame opening for visibly displaying an exhibit to be presented from said viewer's side during use, said frame element having a recess leading from said lateral outer surface to said inner surface and opening into said frame opening for insertion of the exhibit into said frame opening and for removal of the exhibit from said frame opening, said recess being disposed centrally relative to said height of said frame element and said recess having a height being less than said height of said frame element; and a drawer having a receptacle and being displaceably mounted in said recess for positioning the exhibit, said drawer being displaceable between an insertion position in which the exhibit is visible in said frame opening and a removal position in which said receptacle of said drawer is situated outside said frame element for removal of the exhibit from said receptacle;

said frame element having a first transverse side portion on a first side and a second transverse side portion on an opposite side, said first and second transverse side portions being respectively oriented transversely relative to said recess in which said drawer is mounted and said first and second transverse side portions having inner sides associated with said frame opening;

said frame element having a square basic shape as seen from said viewer's side and two mutually parallel longitudinal side portions each having one end being interconnected by said first transverse side portion and another end being interconnected by said second transverse side portion of said frame element, said first and second transverse side portions each having grooves with rectangular cross sections being formed in said inner sides of said first and second transverse side portions;

a closed rear wall supported by said frame element on said rear side;

said receptacle having longitudinal and transverse sides being surrounded by edge strips and having a rear side being closed by a bottom, said edge strips having a height;

one of said edge strips having an outer surface associated with said recess and oriented flush with said outer surface of said frame element surrounding said recess when said drawer is in said insertion position;

said grooves having a height corresponding to said height of said recess and said edge strips permitting said edge strips to be integrated into said frame element and to jointly produce a flat outer surface with said longitudinal side portions of said frame element;

said recess having lateral boundaries with run-on slopes providing said recess with a shape narrowing in a funnel-shaped manner in a direction of said frame opening from said outer surface of said frame element at least over part of a depth of said recess;

said one edge strip associated with said recess having ends assigned to lateral ends of said recess, said ends having respective end portions, and oblique surfaces respectively provided on said end portions, said oblique surfaces having an orientation corresponding to said run-on slopes of said recess and said oblique surfaces lying tightly against said run-on slopes in said insertion position of said drawer.

2. The changeable frame according to claim 1, wherein said receptacle of said drawer is configured for depositing an exhibit being an individual sheet or an individual piece of paper on which an artistic illustration, a drawing, an etching, a print or a photo is reproduced.

3. The changeable frame according claim 2, wherein a depth of said receptacle provided in a side portion of said frame element and disposed opposite to said recess is equal to a thickness of said edge strip associated with said receptacle.

4. The changeable frame according to claim 1, wherein said receptacle of said drawer is configured for depositing a stack of two or more exhibits lying on one another and for making an exhibit of said stack lying uppermost relative to said viewer's side visible in said frame opening when said drawer is in said insertion position.

5. The changeable frame according to claim 1, wherein said frame element has an inner side, and a sliding guide for said drawer is provided on said inner side.

6. The changeable frame according to claim 1, which further comprises a sliding guide provided on at least one of said transverse side portions of said drawer, said sliding guide being said groove provided on at least one of said transverse side portions.

7. The changeable frame according to claim 6, wherein an inner side of said edge strip associated with a respective sliding guide and facing said receptacle of said drawer is oriented flush with one of said inner sides of said respectively assigned transverse side portions.

8. The changeable frame according to claim 6, which further comprises a receptacle provided at an inner side of a portion of said frame element and opposite to an aperture of said recess, said drawer having an edge region assigned to said receptacle in said insertion position.

9. The changeable frame according to claim 8, wherein said inner side of said edge strip associated with a respective sliding guide and facing said receptacle of said drawer is oriented flush with an inner side of a respectively assigned longitudinal side portion in said insertion position of said drawer.

10. The changeable frame according to claim 1, which further comprises a transparent pane filling said frame opening and being held on said frame element for shielding an individual sheet being visible to a viewer in said frame opening relative to the viewer during use.

* * * * *